US005600079A

United States Patent [19]

Feiten et al.

[11] Patent Number: 5,600,079

[45] Date of Patent: Feb. 4, 1997

[54] METHOD AND APPARATUS FOR FULLY ADJUSTING AND INTONATING AN ACOUSTIC GUITAR

[76] Inventors: Howard B. Feiten, 12501 Mitchell Ave., Los Angeles, Calif. 90066; Gregory T. Back, 16000 Sunset Blvd. #1, Pacific Palisades, Calif. 90272

[21] Appl. No.: 376,601

[22] Filed: Jan. 23, 1995

Related U.S. Application Data

[63] Continuation of Ser. No. 896,685, Jun. 10, 1992, Pat. No. 5,404,783.

[51] Int. Cl.[6] ..... G10D 3/14

[52] U.S. Cl. ..... 84/312 R; 84/DIG. 18; 84/298

[58] Field of Search ..... 84/298, 312 R, 84/DIG. 18, DIG. 30

[56] References Cited

U.S. PATENT DOCUMENTS

| | | | |
|---|---|---|---|
| 265,835 | 8/1882 | Rickard | 84/312 |
| 3,599,524 | 12/1969 | Jones | 84/312 |
| 4,236,433 | 12/1980 | Holland | 84/DIG. 10 X |
| 4,911,055 | 3/1990 | Cipriani | 84/299 |
| 4,951,543 | 8/1990 | Cipriani | 84/298 |
| 5,052,260 | 10/1991 | Cipriani | 84/298 |
| 5,063,818 | 11/1991 | Salazar | 84/314 R |

OTHER PUBLICATIONS

Cipriani Bridge Systems Brochure (1992).

*Primary Examiner*—Patrick J. Stanzione
*Attorney, Agent, or Firm*—Lyon & Lyon

[57] ABSTRACT

A fully adjustable acoustic guitar bridge is claimed that allows the strings (nylon or steel) of an acoustic guitar to be separately and continuously intonated accurately and easily whenever necessary. The bridge system employs a minimum of alterations to the traditional non-adjustable acoustic guitar bridge to retain the acoustic qualities of the instrument. Recessed, rear-loaded cap screws utilize the forward pull of the guitar strings to stabilize the adjustable saddles. A threaded saddle capture on each saddle provides stability, continuous threading capability, and the freedom to use acoustically resonant materials (bone, phenolic, composites, etc.) for saddles. These features eliminate the need for springs or other fasteners, which would have a negative effect on the acoustic guitar's tone and sustain. A rosewood shim is employed on acoustic/electric guitars over the internal bridge pickup. The vibration of the saddles on the shim is transmitted to the pickup regardless if the saddles are located directly over the pickup or not. The system has been tested and is compatible with most bridge pickup systems that are currently on the market. The Rule of 3.3%, which cuts 3/64" off of a guitar neck fingerboard (for a neck with a scale length of 25.5") compensates for the various string tensions along the neck to allow for any guitar, with an adjustable bridge and properly located frets, to achieve accurate intonation at all fret positions.

3 Claims, 6 Drawing Sheets

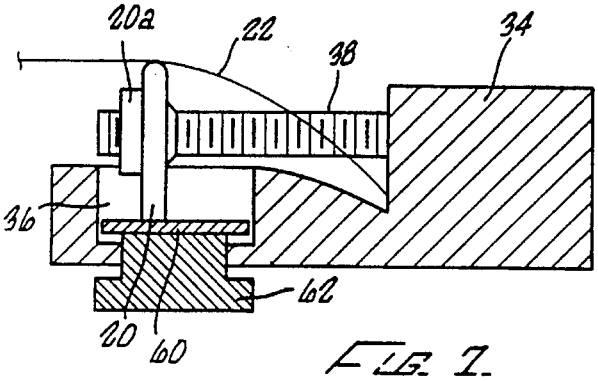
FIG. 7.
FIG. 7a.
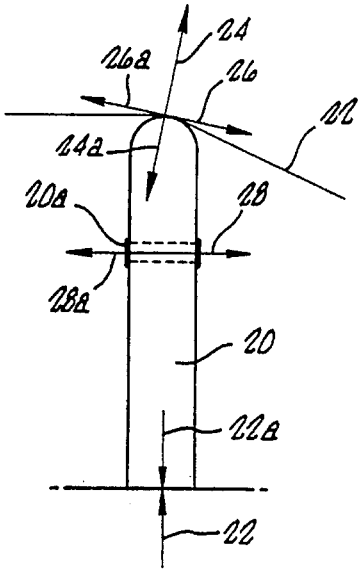
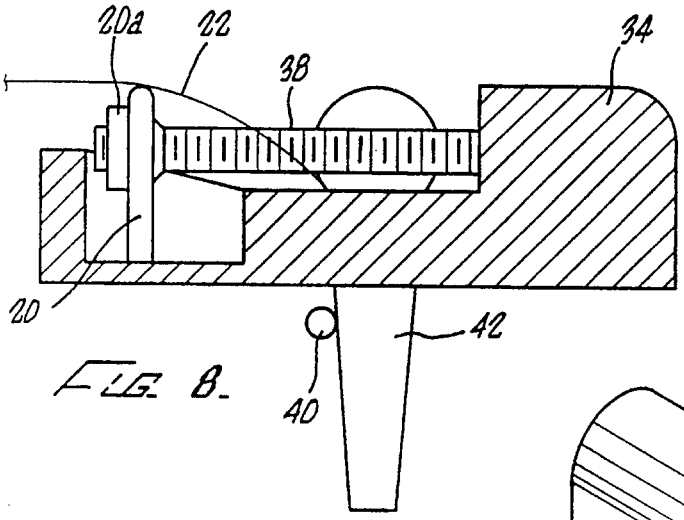
FIG. 8.
FIG. 9.
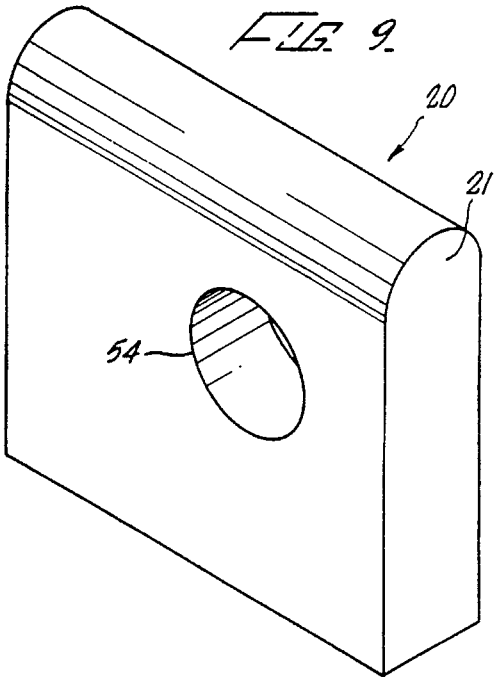
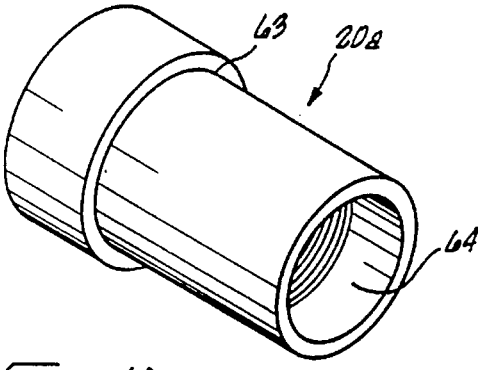
FIG. 10.

METHOD AND APPARATUS FOR FULLY ADJUSTING AND INTONATING AN ACOUSTIC GUITAR

This is a continuation of application Ser. No. 07/896,685 filed on Jun. 10, 1992, now U.S. Pat. No. 5,404,783.

BACKGROUND OF THE INVENTION

The field of invention is adjustable guitar structures and their construction as well as methods to accurately intonate acoustic guitars.

The six-string acoustic guitar has survived many centuries without much alteration to its original design. Prior to the present invention, one very important aspect of acoustic guitars that has been overlooked is providing proper intonation of each string—which is defined as adjusting the saddle longitudinally with the string until all of the notes on the instrument are relatively in tune with each other. Traditional methods of acoustic guitar construction intonate the high and low E strings which are connected to the bridge with a straight non-adjusting saddle. The other four strings are either close to being intonated or, as in most cases, quite a bit out of intonation. Historically, discrepancies in intonation were simply accepted by the artist and the general public as it was not believed that perfect or proper intonation on an acoustic guitar was attainable. The artist accepted this fact by playing out of tune in various positions on the guitar, or developed a compensating playing technique to bend the strings to pitch while playing; which was difficult and/or impossible to do.

Especially in a studio setting, the acoustic guitar must play in tune with more precisely intonated instruments and the professional guitarist cannot have an acoustic guitar that is even slightly off in intonation.

If, for example, the weather or temperature changes, the guitar string gauge is changed, string action (height) is raised or lowered, the guitar is refretted, or a number of any other conditions change, the guitar must be re-intonated. This especially plagues professional musicians who frequently travel or tour giving concerts around the country in different climatic zones, which cause guitars to de-tune and require adjustability in intonation. Airplane travel, with the guitar being subjected to changes in altitude and pressures, exacerbates these problems. Accordingly, adjustability of intonation is desirable due to the many factors which seriously effect the acoustic guitar. Yet, most acoustic guitar companies still use the original non-adjustable single saddle. The fully adjustable acoustic guitar bridge claimed herein is the only system known to the inventors that allows for continuous fully adjustable intonation of each string without sacrificing the sound of the instrument. Thus, there has been a need for the improved construction of adjustable intonation apparatus and methods to properly intonate acoustic guitars.

Attempts to properly intonate acoustic guitars have been made without success. In the 1960's, attempts were made by Gibson® with the Dove® acoustic guitar by putting a so called Nashville Tune-O-Matic bridge® on the acoustic guitar. The Tune-O-Matic was designed for electric guitars and although it theoretically allowed the acoustic guitar to be intonated, the electric guitar metal bridge destroyed the acoustic tone and qualities of the acoustic guitar. Accordingly, these guitars were believed to have been discontinued, or have not been accepted in the market, at least by professional guitar players. In the 1970's, a compensated acoustic guitar bridge was developed which cut the saddle into two or three sections and intonated the guitar strings individually with two, three, or four strings on each saddle. This method however is not individually and continuously adjustable and thus has the major drawbacks listed above. It is important to note that traditional electric guitar bridges either have an adjustment screw running through the metal saddle, with the screw connected at both ends of the bridge (Gibson Tune-O-Matic), or springs loaded on the screw between the saddle and the bridge to help stabilize the saddle (as on a Stratocaster electric guitar). The above construction is not adaptable to acoustic guitars. On an acoustic guitar, if either the screw is connected at both ends of the bridge, or a spring is placed between the saddle and the screw, the saddle will be restricted in its vibration, thereby choking off or dampening the string vibration, resulting in lack of sustain (duration of the note's sound), no tone, or acoustic quality.

Other reasons why electric guitar bridges are not transferrable to acoustic guitars is that electric guitar bridges are constructed of metal which produces a bright tone with the electric guitar strings (wound steel as opposed to the acoustic guitar's wound phosphor bronze strings or nylon). The saddles on an electric guitar bridge are fixed (springs or the adjustment bolt connected at both ends of the bridge) since the pickups (guitar microphones) are located between the bridge and the neck and the electric guitar does not rely on an acoustic soundboard to project the sound. The electric guitar strings simply vibrate between two points and the vibrations are picked up by the electric guitar pickups.

The saddles for the acoustic guitar bridge cannot be made of metal (steel, brass, etc.). The acoustic guitar relies on the string vibrations to be transmitted from the saddles to the base of the bridge. The vibrations go from the bridge to the guitar top (soundboard) and on acoustic/electric guitars to the pickups; either internal under the bridge and/or connected against the soundboard to pickup the soundboard's vibrations. The saddle must be constructed of an acoustically resonant material (bone, phenolic, ivory, etc.) to be able to transmit the string vibrations to the base of the bridge. Metal saddles would dampen these vibrations and the acoustic guitar would produce a thin, brittle tone with very little or no sustain of the notes being played.

The claimed invention solves these problems. The saddle capture has a slight bit of slop or looseness in its threading with the adjustment bolt. Indeed, while round holes with clearance will work, the preferred hole is oval allowing maximum up and down freedom of movement. The saddle must have this small bit of freedom to vibrate in order to transmit the string vibrations into clear, full bodied, warm toned notes that will ring and sustain through the projection of the acoustic guitar's soundboard and/or internal pickups.

Another aspect of the present invention relates to making adjustments to the so-called Rule of 18. Standard guitars are manufactured using a mathematical formula called the Rule of 18 which is used to determine the position of the frets. A short explanation of the acoustic guitar is helpful to understanding this.

The acoustic guitar includes six strings tuned to E, A, D, G, B, and E from the low to high strings. Metal strips running perpendicular to the strings called frets 20, allow for other notes and chords to be played. (See FIGS. 1–4.) The positioning of the frets are determined by employing the Pythagorean Scale. The Pythagorean Scale is based upon the following consonant interval ratios: the fourth, the fifth, and the octave. As shown in FIG. 3, Pythagoras used a movable bridge 50 as a basis, to divide the string into two segments at these ratios. This is similar to the guitar player's finger pressing the guitar string down at selected fret locations between the bridge and the nut (FIG. 4).

To determine fret positions, guitar builders use a mathematical formula based from the work of Pythagoras called the Rule of 18 (the number used is actually 17.817). The guitar scale length is divided by 17.817. This is the distance from the nut (see FIG. 5) to the first fret. The remaining scale length is divided by 17.817 to determine the second fret location. This procedure is repeated for all of the fret locations up the guitar neck. For example, focusing on FIGS. 5A and 5B, in an acoustic guitar with a scale length of 25.5", the following calculations are appropriate:

| | | |
|---|---|---|
| 25.5 ÷ 17.817 = 1.431" | (a) | distance from nut to first fret |
| 25.5 − 1.431 = 24.069" | | |
| 24.069 ÷ 17.817 = 1.351" | (b) | distance between first and second fret |
| or | | |
| 1.431 + 1.351 = 2.782" | | distance from nut to second fret |

The procedure and calculations continue until the required number of frets are located. Some altering of numbers is required to arrive at having the twelfth fret location exactly at the center of the scale length and the seventh fret producing a two-thirds ratio for the fifth interval, etc.

Unfortunately, this system is inherently deficient in that it does not result in perfect intonation. As one author stated: "Indeed, you can drive yourself batty trying to make the intonation perfect at every single fret. It'll simply never happen. Why? Remember what we said about the Rule of 18 and the fudging that goes on to make fret replacement come out right? That's why. Frets, by definition, are a bit of compromise, Roger Sadowsky observes. Even assuming you have your instrument professionally intonated and as perfect as it can be, your first three frets will always be a little sharp. The middle register—the 4th through the 10th frets—tends to be a little flat. The octave area tends to be accurate and the upper register tends to be either flat or sharp; your ear really can't tell the difference. That's normal for a perfectly intonated guitar." (See *The Whole Guitar Book,* "The Big Setup," Alan di Perna p.17, *Musician* 1990.

While this prior art system is flawed, prior to this invention it was just an accepted fact that these are the best results that guitar makers have come up with.

SUMMARY OF THE INVENTION

The present invention is directed to improved structures and methods to accurately intonate acoustic guitars.

In the first aspect of the invention, an acoustic guitar is disclosed that allows the strings (nylon or steel) to be intonated accurately and easily whenever necessary by use of the claimed adjustable bridge. The bridge system employs a minimum of alternations to the traditional acoustic guitar bridge to retain the acoustic and tonal qualities of the instrument. The traditional appearance is less likely to receive resistance from most musicians, who are usually purists and traditionalists at heart. The recessed, rear-loaded cap screws utilize the forward and downward pull of the guitar strings to stabilize the saddles. A threaded saddle capture on each saddle provides stability, continuous threading capability, and the freedom to use various acoustically resonant materials (bone, phenolic, composites, etc., but not metal) for saddles.

Acoustically resonant material is material which will accept sound waves (due to string vibrations) delivered to it at one point and transmit those waves to another source (the base of the acoustic guitar bridge) with little or no degradation of the sound waves. Bone, phenolic, ivory, etc., are examples of acoustically resonant materials. Metal will transmit sound waves through itself but its mass and density will soak up and dampen the sound waves. These features eliminate the need for springs or multipoint fasteners which would have a negative effect on the acoustic guitar's tone and sustain. The claimed structure also allows for a single unthreaded connection to the guitar body avoiding single or double screw thread connections which are deleterious to tone. A 0.040" rosewood shim is employed over the internal bridge pickup. The vibration of the saddles on the shim is transmitted to the pickup regardless if the saddles are located directly over the pickup or not. The system has been tested and is compatible with most bridge pickup systems that are currently on the market.

In another aspect of the invention, it was discovered that the string, neck and fret design of a standard guitar, manufactured by using the standard of Rule of 18 was flawed and if a percentage, i.e., approximately 3/64" (on a scale length of 25.5"), or approximately 3.3%, was removed from the neck, perfect or close to perfect intonation was obtained due to correct fret placement and proper finger pressure.

BRIEF DESCRIPTION OF THE DRAWINGS

FIG. 7 is another section view of the bridge (for a nylon string acoustic guitar) with the electronic pickup embodiment, with all of the preferable parts shown, including the guitar string, saddle, capture, screw shim and internal bridge pickup.

FIG. 7A is a free body diagram of the forces exerted by the string and screw on the saddle and on the pickup.

FIG. 8 is another sectional view of the bridge (for the steel string acoustic guitar) without pickup embodiment, with all of the preferable parts shown, including the guitar string, saddle, screw and shim.

FIG. 9 is an elevation drawing of the string saddle. The claimed bridge requires six individual saddle elements so that each string can be intonated separately.

FIG. 10 is an elevated perspective of the threaded saddle capture which is attached (preferably press-fitted) to the saddle.

DETAILED DESCRIPTION OF THE PREFERRED EMBODIMENT

Figure 1A:
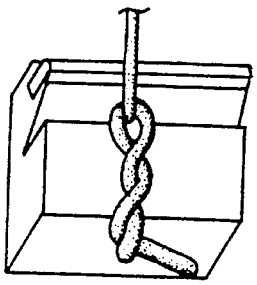
FIGS. 1A and 1B show two conventional methods of securing string to the bridge of an acoustic guitar.
Figure 1B:
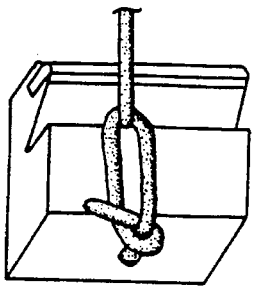
Figure 1:
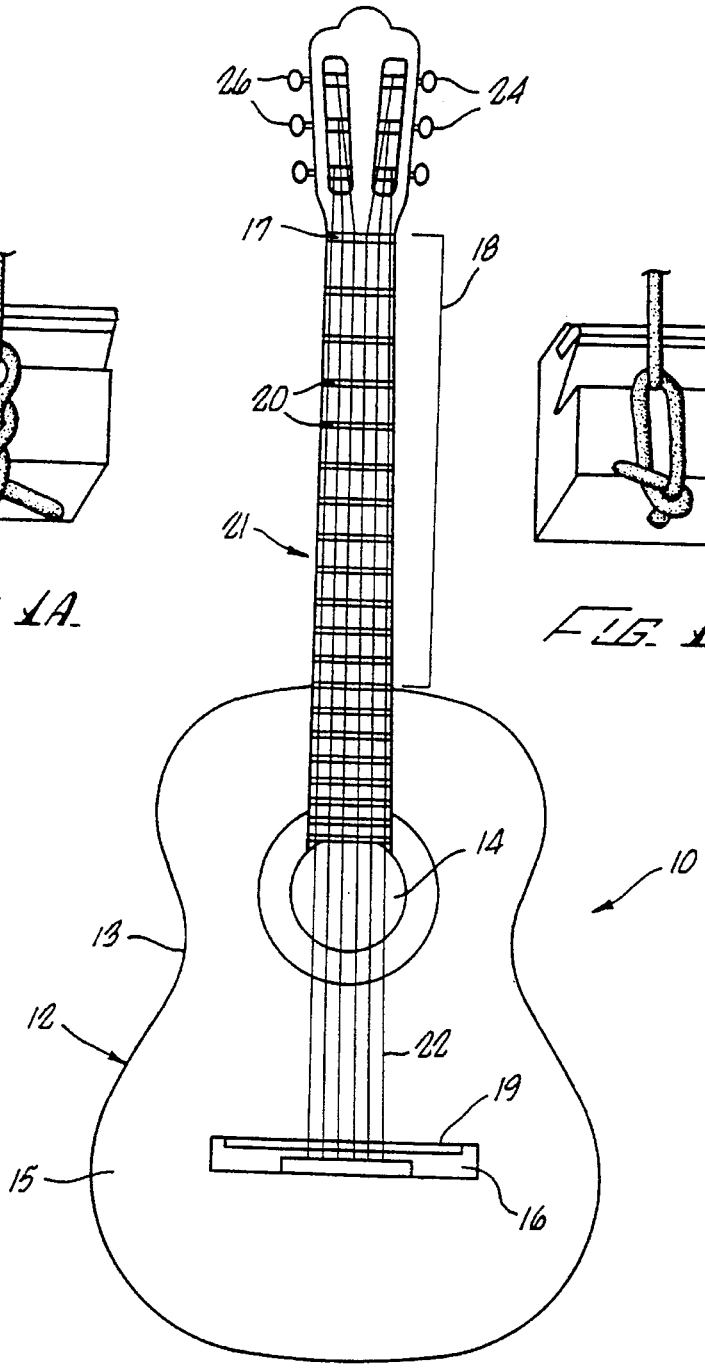
FIG. 1 shows a top view of a conventional acoustic guitar having a neck, a body, a resonant cavity or soundhole, and a bridge.
Figure 1C:
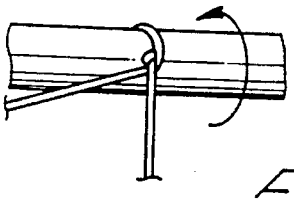
FIG. 1C. PRIOR ART
FIG. 1C shows the conventional method of securing the string to the tuning keys of an acoustic guitar.

FIG. 1 shows the basic configuration of a conventional classic acoustic guitar 10 having a guitar body 12 having sides 13 and a top or soundboard 15 on which is mounted bridge 16. Guitar strings 22 stretch over the resonant cavity or soundhole 14 and on to the head stock 24 and tuning keys 26. A bridge 16 and a saddle 19 is mounted on the top (or on the soundboard) 15 of the guitar body 12. Upraised metal ridges called frets 20 are located at designated intervals on the handle perpendicular to the strings. A typical guitar has about twenty frets. As set forth in the background of the invention, the positioning of the frets was conventionally determined by the so-called Rule of the 18. As also indicated in the Background of the Invention, conventional wisdom blindly followed this rule and led to the conclusion that proper intonation was not possible. FIG. 1 also shows the ridge 17 called the "nut", which is typically made of bone (traditional) or plastic, ivory, brass, or graphite. The nut 17 is located at the end of the fingerboard 21 just before the headstock 24. It allows for the strings to be played open, (i.e., unincumbered) non-fretted notes. The nut 17 has six slots equally spaced apart, one for each string. The proper depth of the nut slot (for string) is that the string is 0.020" above the first fret (this is a common measurement among guitar makers), to allow the open note to ring true without buzzing on the first fret. A lower spec at the first fret would allow less pressure at the lower frets (first through fifth), and result in closer proper intonation at these frets; however, the open position would be unplayable due to excessive string buzzing upon the first fret.

Figure 2:
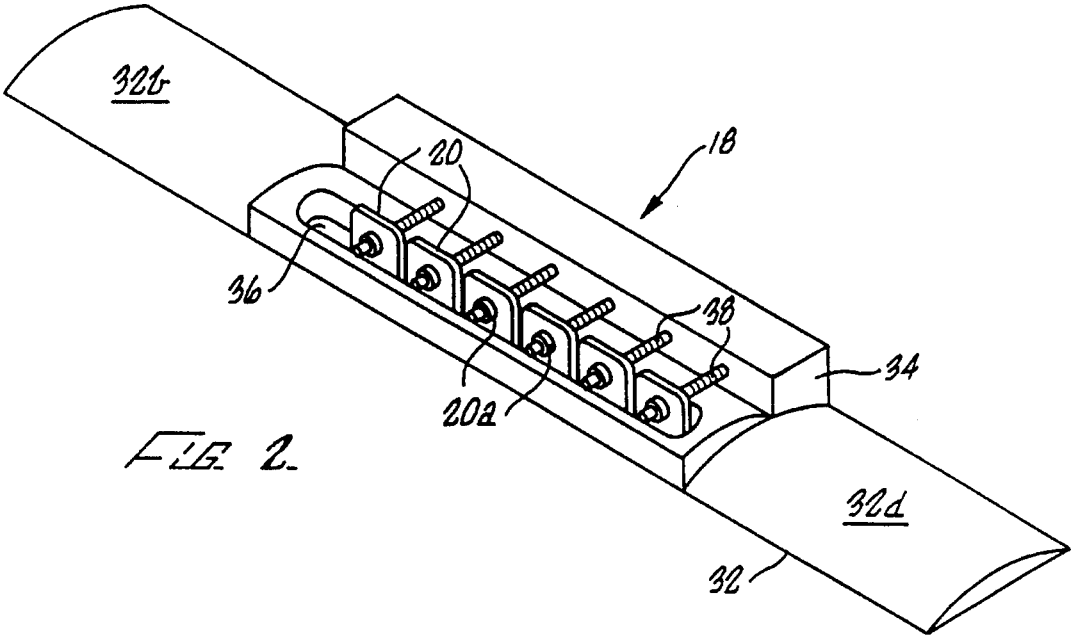
FIG. 2 shows an elevated view of the claimed fully adjustable acoustic bridge which is mounted on the guitar body.

FIG. 2 shows an elevated drawing of the adjustable bridge 18. The bridge utilizes individual saddles 20 which are adjustable in a direction longitudinal to the strings 22 and perpendicular to the neck 18. In the best mode, each saddle is located on a groove or trough 36. Each individual saddle has an attached threaded saddle capture 20*a*, which stabilizes and fortifies the connection between the saddles (which are typically made of non-metal or other soft material) and screws 38 which are threaded into the saddle captures. This is also shown in FIGS. 6, 7 and 8. The head of each screw is rotatably connected to transverse boss 34, which extends substantially perpendicular to the strings and substantially parallel to the groove and which forms part of the frame or housing 32. Turning each screw 38 causes the movement of each connected saddle in a direction longitudinal to the strings to accomplish proper intonation. Bridge frame or housing 32 has extensions 32*a* and 32*b* which add support and optimize the picking up of the vibration off the body and from the resonant cavity.

Figure 3:
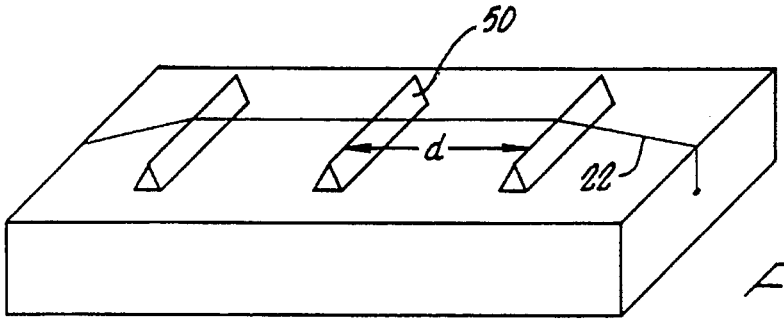
FIG. 3 is an illustrative drawing to illustrate the Pythagoras Monochord (theoretical model), utilizing a movable bridge.
Figure 4:
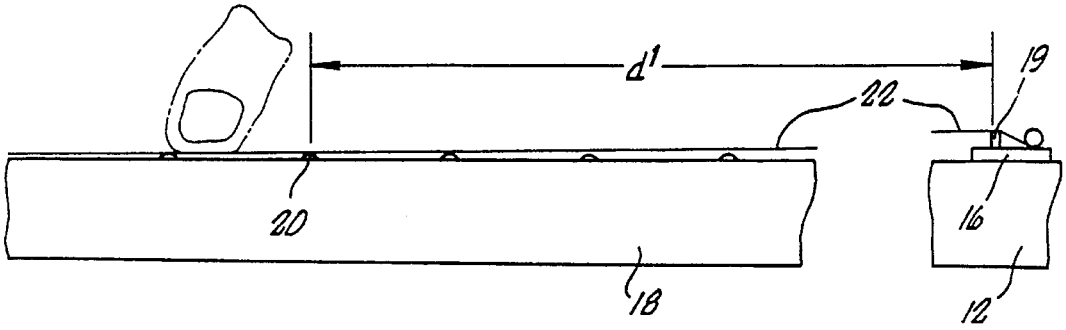
FIG. 4 shows a blown up and fragmented illustration of the relationship between the fingers, frets, saddle and bridge in the actual playing of a guitar, as compared to the theoretical model in FIG. 3.

FIG. 3 is a theoretical illustration for purposes of understanding the conventional Rule of 18. The positioning of moveable bridge or fret 50 causes shortening or lengthening of the length of the string d (FIG. 3), changing the pitch of string 52. The positioning of the frets is determined by employing the Pythagorean theory with regard to moveable bridge 50 to develop the string into segments of the desired ratio. The human finger tries to approximate this in the playing of a guitar, as illustrated in FIG. 4. When the human finger depresses the string, contact is made with an adjacent fret changing the length $d^1$ of the resonant string. The frets normally do not touch the string until the string is depressed by the human finger when the guitar is played. This helps explain the present invention. The subject inventors appreciated that the application of the Pythagorean theory is premised on the string being under constant tension, which in fact is not the case when the guitar is actually being played and the string is under different tensions at different positions along the guitar neck when fretted by the human finger.

Figure 5A:
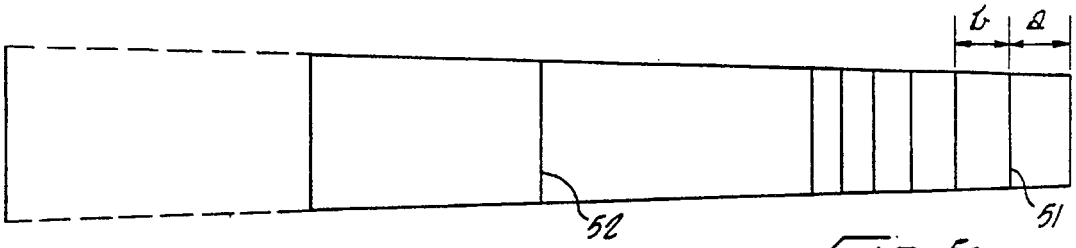
FIG. 5A shows a pictorial of the neck of a conventional guitar to explain the Rule of the 18's.
Figure 5B:
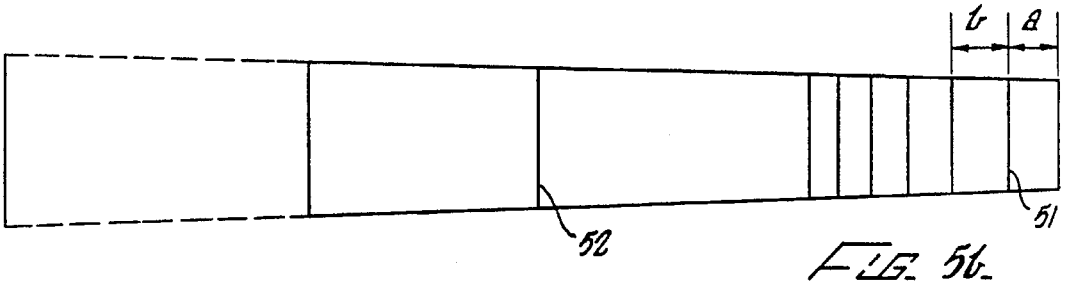
FIG. 5B shows a pictorial of the claimed guitar illustrating compensation for, and explanation of the Rule of the 18's and Rule of the 3.3%. On a 25.5" scale length guitar, about 3/64" is removed from the neck.

FIGS. 5(*a*) and 5(*b*) illustrate how the Rule of the 18 is applied to position the frets on the neck of a traditional guitar in contrast to the subject invention. FIG. 5(*a*) illustrates a traditional guitar neck. The first fret 51 is shown as being a distance away from the nut. Typically, the length of the string from the bridge to the nut is 25.5". The 12th fret 52 is also shown. The position of each fret is conventionally determined by the Rule of 18, as previously set out. Intermediate frets are not shown. As noted, the traditional thinking did not take into consideration the varying of the tension as the guitar player pushes on the string to make contact with different frets at different positions of the neck. Yet, as stated previously, the frequency of a stretched string under constant tension is inversely proportional to its length ($f \alpha 1/2$). This is what the Pythagorean monochord represents and the basis in which the Rule of 18 is determined (See FIGS. 3–5). What the prior art failed to appreciate is a variation of string tension produced at various fret locations. The string tension is not constant when fretted along the guitar neck. It requires more pressure at the lower fret locations (e.g., near the nut 17 in FIG. 1) than it does in the upper locations (towards the bridge 16). The Rule of 18 views the nut as a fret position, however, the nut is higher than the fret height to allow for the open string positions to be played. This inevitably results in lack of proper intonation—which leads to another aspect of the invention—what the inventors coined as the Rule of 3.3% compensation. In the best mode, the actual number is 3.2759675%. The calculations follow: For a neck with a scale length of 25.5" the nut to first fret distance is 1.430875" (by Rule of 18). 1.430875"×0.032759675 (3.3%)=0.046875" or 3/64". 1.430875"−0.046875"=1.3840". This is the proper distance between nut and first fret for accurate intonation. This compensation works regardless of string gauge.

The Rule of 3.3% compensation allows for any guitar with properly located frets and an adjustable intonatable bridge to achieve accurate intonation at all fret positions. This rule has the fret locations determined as previously described by the Rule of 18 with one alteration; once all of the fret positions are determined, go back to the nut and multiply 0.032759675 (3.3%) to the distance from the nut to the first fret. For a scale length of 25.5", the 3.3% compensation will be 3/64". In simple terms, cut 3/64" (3.3%) off of a guitar neck fingerboard at the nut end that already has its fret slots cut. The 3.3% compensation of the fingerboard compensates for the various string tensions along the neck, and for the increased string height at the nut. The Rule of 3.3% compensation has been tested and proven for all types of guitars: acoustic or electric, steel or nylon string. Research was done on the 25.5" scale since this is the most commonly preferred and produced scale length.

Figure 6A:
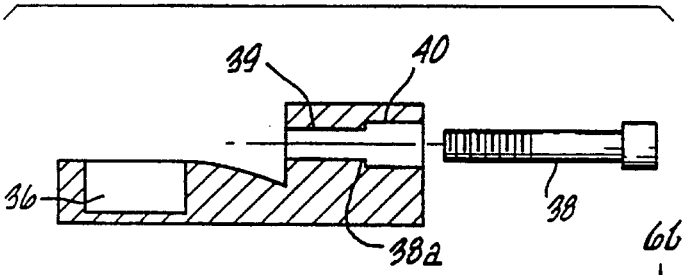
FIG. 6A is a section view through Section A—A of FIG. 6 of the saddle adjustment screw hole through the boss or ridge on the anterior portion of bridge. The hole does not contain threads and is preferably oval to limit side-to-side movement but allow up and down movement.

Turning now to the details of the bridge, FIG. 6A is a section view of a typical opening within which saddle adjustment screw 38 is inserted through a hole in the boss 34 on the bridge (Section A—A). The channel 39 is slightly oversized for the 4-40 socket head cap screw which is used in the best mode. The head of the screw rests on a circular shoulder 38*a*. The hole is stepped 40 to allow seating of the screw cap. The hole 39 has clearance and the screw that contacts it is preferably not threaded. While a round hole works an oval opening is better allowing for greater freedom of movement up and down than laterally. The clearance will allow the saddle to vibrate up and down and side to side in channel 36 as it does in a normal acoustic guitar bridge system. This non-restricted motion also allows an acoustic guitar with a bridge pickup to perform to its maximum potential in an amplified situation. Most acoustic/electric guitars employ some type of piezo crystal for amplification. A piezo crystal relies on pressure acting as a vibration sensor, where each vibration pulse produces a change in current. The saddles must be allowed freedom to vibrate to let the piezo pick up all of the vibrations. Unrestricted downward pressure of the saddle on the piezo is essential; however, back and forth (longitudinally—with string) is also required to allow for intonation. A free body diagram is shown in FIG. 7A which shows the forces on saddle 20 by string 22 and capture 20*a*. Vectors 24, 24*a*, 26 and 26*a* depict stresses caused by the string tension. Vectors 22 and 22*a* show saddle-to-bridge forces. Vectors 28 and 28*a* depict approximate forces caused by stop/play action. The saddle transmits the vibrations to the bridge and/or pickup.

Figure 6B:
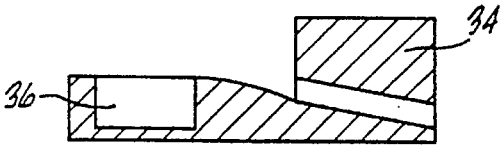
FIG. 6B a section view of the guitar string channel through the bridge taken along Section B—B of FIG. 6, showing the groove through which the string passes.
Figure 6:
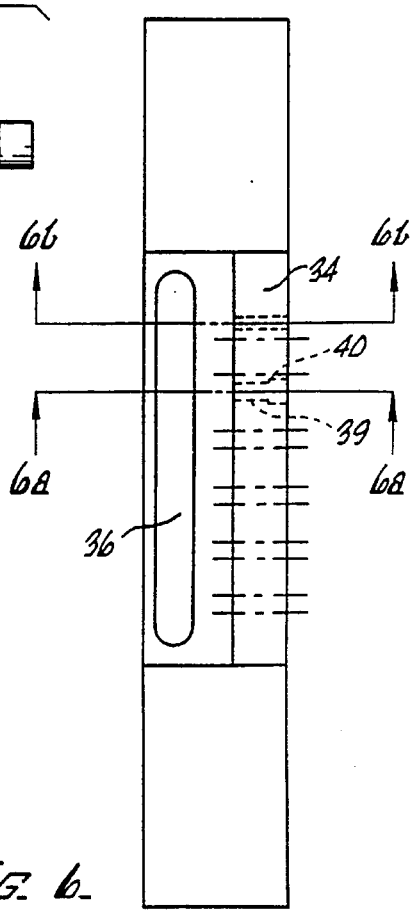
FIG. 6 shows a top view and partial cross-section of the claimed bridge.

FIG. 6B is a sectional view of the guitar string channel through the bridge (Section B—B). The string can be tied in traditional classical style (over the bridge) or knotted and sent directly through the channel. In this embodiment, a nylon string bridge is shown. The steel string bridge system is the same in design except that the steel string (with the ball end 40) is held by a bridge pin 42 located between the saddle channel and the screw channel. (See FIG. 8).

FIG. 7 is a sectional view of the bridge showing all of the desired parts for nylon string application with an electronic pickup. The guitar string 22 passes through the string channel (for the nylon string embodiment) or to the bridge pin (for the steel string embodiment; e.g., FIG. 8), making contact on the top of the saddle 20 and continuing up the neck 18 to the headstock 24. The saddle is stabilized by the forward and downward pull of the guitar string and the threaded capture 20*a* and screw 38 attachment. A force diagram is shown in FIG. 7A. In the best mode, 4-40 socket head cap screws 38 are used. The screws are threaded through the capture and allow the forward to backward adjustment (intonation) of the saddle by using a 3/32" allen wrench inserted from behind the bridge. In the best mode, the saddle rests upon a 0.040" rosewood shim, 60, which rests upon the guitar bridge pickup 62. The saddle 20 can rest upon the solid base of the bridge on acoustic guitars without a bridge pickup. The rosewood shim 60 should be slightly undersized from the channel it sits in to allow for freedom of movement and vibration. This will prevent the string vibration from being choked off or dampened and utilize the guitar pickup to its maximum potential.

Figure 7B:
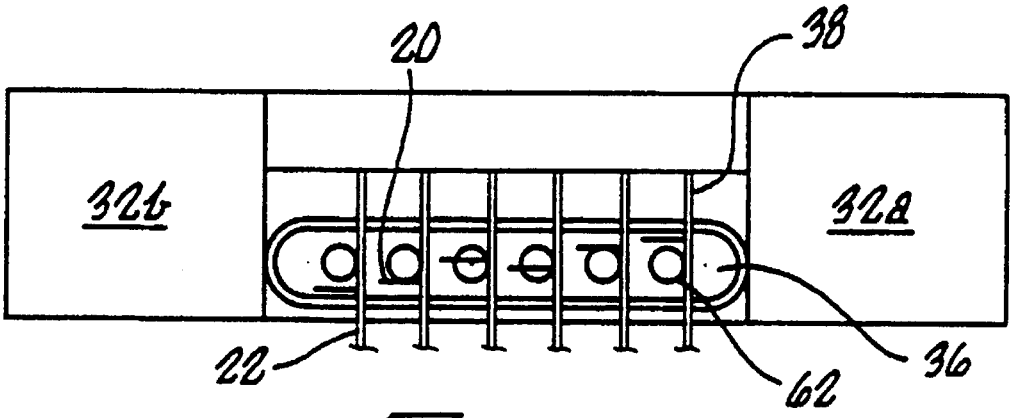
FIG. 7B is a top view of the bridge generally shown in FIG. 7 with the electronic pickup.
Figure 7C:
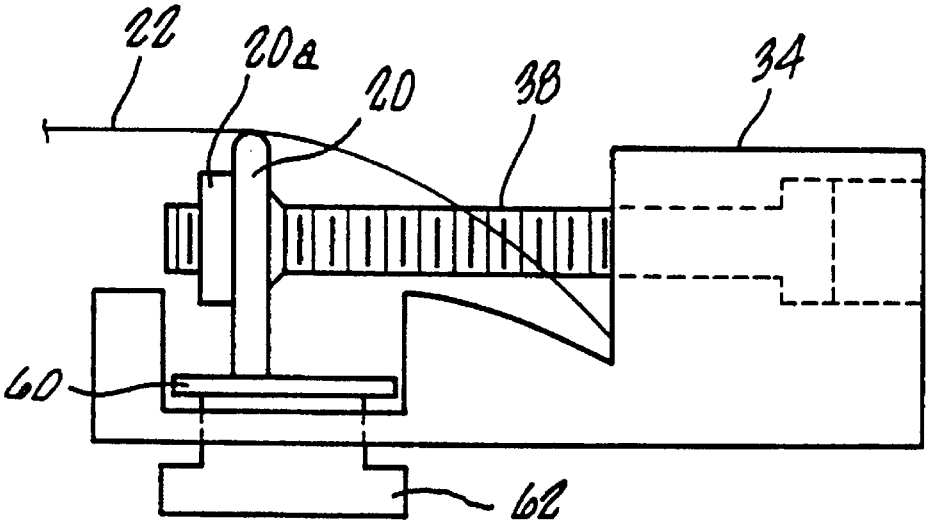
FIG. 7C is a vertical view of the apparatus in FIG. 7B.

FIG. 7*b* is a top view of the embodiment set out in FIG. 7. Individual saddle elements 20 support individual strings 22. As indicated previously, saddle capture 20*a* is in the best mode located off center. Screw 38 is threaded into off center capture 20*a*. This is also indicated in FIG. 7*c* which is a side view of the bridge shown in FIG. 7B. They are set out in the same drawing page so that both views can be looked at simultaneously by reader.

FIG. 8 illustrates another aspect of this invention, namely, utilizing a steel string and no pickup. The string ball end 40 is shown as well as bridge pin 42. The saddle is phenolic in the best mode.

Figure 11:
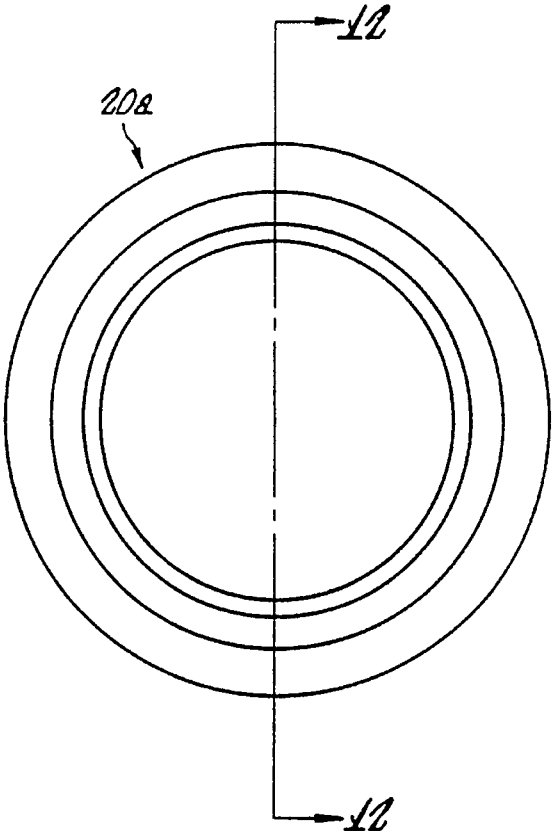
FIGS. 11 and 12 are additional drawings of the saddle capture.
Figure 12:
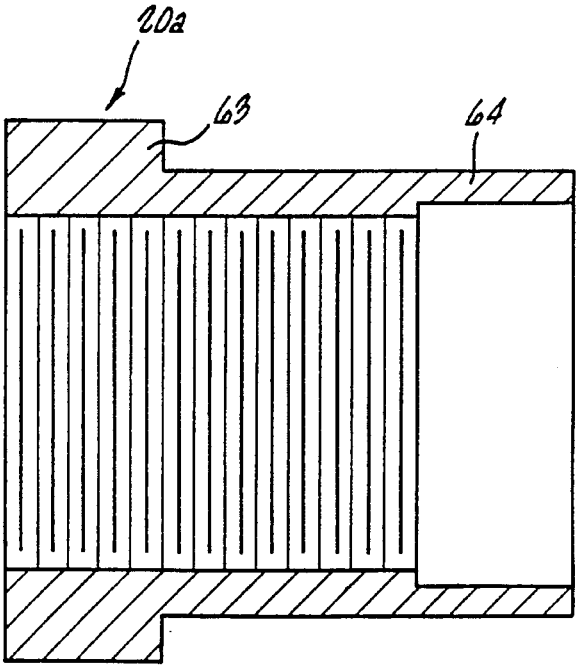

FIG. 9 is an elevated drawing of the saddle 20. The claimed bridge requires six individual longitudinally adjustable saddles, or saddle elements, upon which each string rests so that each string can be intonated separately. The bottom of each saddle element must be straight and sit flush with the base of the bridge or rosewood shim. The top of the saddle has a radius edge 21 to provide minimal string contact, necessary for intonation and tone. Hole or opening 54 is located in the saddle to hold the threaded saddle capture 20*a*. Saddle material can be traditional bone or other composite materials. It cannot be steel or non-acoustically resonant material (see Background of Invention). Research on the claimed bridge indicates the best results attained with bone for the nylon string and phenolic for the steel string. Other composites such graphite, plastic, ivory, Corian®, can be used FIG. 10 is an elevated perspective of the threaded saddle capture 20*a*. The threaded saddle capture is located in an opening or hole through the saddle and provides saddle stabilization and reliability and ease of adjustment as the intonation adjustment screw (M4-40 SOC HD CAP SCR) is threaded through for intonation adjustment. In the best mode, collar 63 is provided. Extra material 64 is used to form an adjacent collar during the press fit operation. The capture is a machined steel, brass or hard material part that becomes a permanent fixture in the saddle when inserted in the hole and pressed in a vise. Experiments have show that while use of acoustically resonant material for saddles without a capture has worked for short periods of time, a capture is needed for reliable long-life operation. The capture is offset from the string location on the saddle. In other words, the screw is not in the center of the saddle. The string is over only the saddle material, thereby directly transmitting the string vibrations unobstructed by the screw, etc. This allows the string vibrations to transmit directly through the saddle material unaffected by the mass of the capture. FIGS. 11 and 12 are additional drawings of the saddle capture. FIG. 7 also shows the rosewood shim 60. In the best mode, a 0.040" thick rosewood shim is used between the saddle and the internal bridge pickup. Employing rosewood allows the saddle and string to vibrate as it would on an acoustic guitar without a bridge pickup. The shim must be slightly smaller than the bridge channel to permit it to freely vibrate. Rosewood also lets the vibration of the saddles on the shim to be transmitted to the pickup, regardless if the saddles are located directly over the pickup or not. This feature is necessary since the area over which the intonation of the six strings fall is larger than the width of most guitar bridge pickups.

In operation in the best mode, the claimed infinitely adjustable saddle is utilized as follows to accurately intonate a guitar: First, an open string is struck; in other words the string is struck and allowed to oscillate freely. The open string is then tuned to the "E" note using a tuner thereby setting the open string to the so called true pitch. Typical commercially available tuners can be used for this purpose.

The same string is then fretted at the 12th fret and also struck. In other words, the finger of the guitarist depresses the string so that it touches the 12th fret and the string is now only free to oscillate between the 12th fret and the bridge. This fretted note should be one octave higher that the open string note on the same string. A tuner once again is used to check whether the 12th fret note is the same note as the open string.

If a discrepancy is noted, the saddle element upon which that particular string rests is longitudinally adjusted utilizing an allen wrench to turn the screw thereby longitudinally adjusting the saddle element in relation to the string. As the screw is turned, the saddle is physically adjusted by virtue of the threaded connection between the screw and the capture.

Testing and continuous adjusting is repeated until the intonation of the threaded string matches the intonation of the open string. This method is repeated for all other stings. As can be seen, each string is individually and infinitely adjusted so that it can be properly intonated.

While multiple embodiments and applications of this invention have been shown and described, it should be apparent that many more modifications are possible without departing from the inventive concepts therein. Both product and process claims have been included, and it is understood that the substance of some of the claims can vary and still be within the scope of this invention. The invention, therefore, can be expanded and is not to be restricted except as defined in the appended claims and reasonable equivalence therefrom.

We claim:

1. A method of intonating an acoustic guitar having a body, strings, frets, and a bridge having continuously adjustable acoustically resonant saddle elements including the following steps:

a) striking an open (non-fretted) string;

b) tuning said open (non-fretted) string to a note, thereby setting the open string to the true pitch;

c) striking the same string while fretted at the 12th fret (fretted string) producing a note which is one octave higher than the open string note on the same string;

d) comparing said 12th fret note to the open string note;

e) longitudinally adjusting the saddle element of said fretted string by turning a screw threaded to said saddle and connected to said body thus physically adjusting the longitudinal position of said saddle element until the intonation of the fretted string matches the open string;

f) similarly intonating all other strings to their respective pitches.

2. A method of intonating an acoustic guitar having a body, strings, frets, with the distance between the nut and the first fret being in the range of 1 to 10% shorter than standard, and a bridge having continuously adjustable acoustically resonant saddle elements including the following steps:

a) striking an open (non-fretted) string;

b) tuning said open (non-fretted) string to a note, thereby setting the open string to the true pitch;

c) striking the same string while fretted at the 12th fret (fretted string) producing a note which is one octave higher than the open string note on the same string;

d) comparing said 12th fret note to the open string note;

e) longitudinally adjusting the saddle element of said fretted string by turning a screw threaded to said saddle and connected to said body thus physically adjusting the longitudinal position of said saddle element until the intonation of the fretted string matches the open string;

f) similarly intonating all other strings to their respective pitches.

3. A method of intonating guitar having a body, strings, frets, with the distance between the nut and the first fret being in the range of 1 to 10% shorter than standard, and a bridge having continuously adjustable saddle elements including the following steps:

a) striking an open (non-fretted) string;

b) tuning said open (non-fretted) string to a note, thereby setting the open string to the true pitch;

c) striking the same string while fretted at the 12th fret (fretted string) producing a note which is one octave higher than the open string note on the same string;

d) comparing said 12th fret note to the open string note;

e) longitudinally adjusting the saddle element of said fretted string thus physically adjusting the longitudinal position of said saddle element until the intonation of the fretted string matches the open string;

f) similarly intonating all other strings to their respective pitches.

* * * * *